US008832949B2

(12) United States Patent
Allen et al.

(10) Patent No.: US 8,832,949 B2
(45) Date of Patent: Sep. 16, 2014

(54) DOOR FRAME TOOL

(75) Inventors: Brian C. Allen, Raleigh, NC (US); James S. Ketcham, Garner, NC (US)

(73) Assignee: Allen Innovations, LLC, Cary, NC (US)

( * ) Notice: Subject to any disclaimer, the term of this patent is extended or adjusted under 35 U.S.C. 154(b) by 154 days.

(21) Appl. No.: 13/410,750

(22) Filed: Mar. 2, 2012

(65) Prior Publication Data

US 2012/0255186 A1 Oct. 11, 2012

Related U.S. Application Data

(60) Provisional application No. 61/472,787, filed on Apr. 7, 2011.

(51) Int. Cl.
*E06B 1/04* (2006.01)

(52) U.S. Cl.
CPC ..... *E06B 1/04* (2013.01)
USPC ..... 33/194; 33/404; 33/464

(58) Field of Classification Search
USPC ..... 33/194, 474, 404, 464, 645
See application file for complete search history.

(56) References Cited

U.S. PATENT DOCUMENTS

| | | | | | |
|---|---|---|---|---|---|
| 1,336,426 | A * | 4/1920 | Fredericksen | ..... | 33/194 |
| 1,595,164 | A * | 8/1926 | Mundy et al. | ..... | 33/194 |
| 2,570,430 | A * | 10/1951 | Cramer | ..... | 33/342 |
| 3,851,868 | A * | 12/1974 | Lagasse | ..... | 33/194 |
| 5,340,095 | A * | 8/1994 | Eicher, III | ..... | 269/43 |
| 6,148,529 | A * | 11/2000 | Kennedy | ..... | 33/374 |
| 6,237,233 | B1 * | 5/2001 | Cloutier et al. | ..... | 33/194 |
| 6,282,852 | B1 * | 9/2001 | Walcker | ..... | 33/194 |
| 7,587,833 | B2 * | 9/2009 | Bittner et al. | ..... | 33/474 |
| 2002/0170189 | A1 * | 11/2002 | Cheatham | ..... | 33/194 |
| 2012/0255186 | A1 * | 10/2012 | Allen et al. | ..... | 33/194 |

* cited by examiner

*Primary Examiner* — Yaritza Guadalupe-McCall
(74) *Attorney, Agent, or Firm* — Ward and Smith, P.A.

(57) ABSTRACT

Apparatuses and methods are provided for squaring, positioning, and leveling a door frame. The apparatus comprises a generally rectangular body, at least two magnets, and at least one leveling device. The method generally comprises positioning the apparatus of the invention in the center of where a doorway will be placed, contacting the vertical sides of the door frame with the apparatus such that each of the magnets on the apparatus is in magnetic contact with a vertical side of the door frame, and using the apparatus to correctly square, level, and set the door frame.

32 Claims, 2 Drawing Sheets

DOOR FRAME TOOL

CROSS-REFERENCE TO RELATED APPLICATIONS

This application claims priority and is related to U.S. Provisional Patent Application Ser. No. 61/472,787, filed Apr. 7, 2011, the disclosure of which is incorporated by reference in its entirety.

BACKGROUND OF THE INVENTION

1. Technical Field

The invention disclosed herein relates generally to the field of construction, and more particularly to providing apparatuses and methods for the positioning and leveling of door frames.

2. Background Art

When a door frame, such as a metal door frame, is to be installed, it is necessary to position the vertical frame supports at a specific distance from each other to establish the proper gap between the vertical frame supports. In addition, each side of the door frame needs to be leveled in relation to the ground/floor. Also, alignment of the vertical stud to the frame is required before affixing the frame to the stud. Typically, installation of a door frame requires such tools as tape measures to calculate distances, leveling tools to make sure the door frame is level, and the like.

Tools to aid in the installation of door frames have been proposed in the past. For example, U.S. Pat. No. 6,807,777 to Wagner, Ratliff, and Zochowski provides a rectangular block with slots that can be positioned on one side of a door frame to aid in positioning a door frame. Magnets at the bottom of the slots temporarily affix the tool to the outside edge of the door frame to allow hands-free operation. However, the tool cannot be used for leveling of the door frame, the tool requires a metal track on the floor up to the location of where a door is to be positioned, and at least two tools are required to establish the appropriate gap between the door frame and the metal track.

U.S. Pat. No. 7,240,436 to Miller and Shultz is directed to an alignment and positioning guide tool that is positioned over a stud wall mounting base plate and slidably positioned to engage with a door jam during framing. This tool also cannot be used for leveling of the door frame and does not incorporate magnets to aid in positioning of the door frame.

U.S. Pat. No. 4,733,475 to Youmans discloses an extension level apparatus suitable for use with a carpenter's level and includes a spring loaded extension member which permits the extension level to be retained in a wall opening. This apparatus is vertically aligned next to one side of a door frame. However, this tool is overly long because it spans the vertical side of the door frame and, furthermore, it requires the addition of a carpenter's level.

As such, a need exists for a compact tool that can, quickly and easily, square, position, and level a door frame.

BRIEF SUMMARY OF THE INVENTION

According to one embodiment of the present invention, an apparatus for squaring, positioning, and leveling a door frame, such as a metal door frame, is provided wherein the apparatus may include a generally rectangular body; at least two magnets, one on each shorter side of the rectangular body; and at least one leveling device attached to the rectangular body. The apparatus may further include a line parallel to the longer sides of the rectangular body in the center of the rectangular body and extending the length of the rectangular body. Wherein there may be a center point in the middle of the apparatus and the center point may intersect the line parallel to the longer sides of the rectangular body. The center point may include a slot formed therein, wherein the slot is configured to accept a laser device, for example a multidirectional laser. The slot may further include an adjustable locking mechanism, such as slide lever, to secure the laser device in the slot. The apparatus may further include a handle to carry the apparatus. The apparatus may further include one or more spacers, and the one or more spacers may be tethered to the apparatus. The apparatus may further include at least one magnet that is extendable from at least one of the shorter sides of the rectangular body. The magnet may be extendable by a mechanical lever. In one example, the apparatus in an extend state is approximately 36 inches in length. In one example, the center point is located at the middle of the apparatus, wherein the middle of the apparatus is measured based on the apparatus having at least one magnet extended.

According to another embodiment of the present invention, an method for squaring, positioning, and leveling a door frame, such as a metal door frame, is provided wherein the method may include providing an apparatus for squaring, positioning, and leveling a door frame, wherein the apparatus may include: a generally rectangular body; at least two magnets, one on each shorter side of the rectangular body; and at least one leveling device attached to the rectangular body. The method may further include placing the apparatus of the invention where a doorway is desired; contacting each vertical side of the door frame to the apparatus such that a magnet on each side of the apparatus is in magnetic contact with a vertical side of the door frame; leveling the door frame in relation to the floor using the at least one leveling device of the apparatus; securing the door frame; and removing the apparatus. The method may further include positioning one or more door frame studs correctly relative to the door frame. The method may further include securing the door frame to the one or more door frame studs. The method may further include using one or more spacers to position one or more door frame studs correctly relative to the door frame. The method may further include using a laser device, such as a multidirectional laser, to aid in properly squaring and positioning the door frame. The method may further include extending at least one of the at least two magnets to come into magnetic contact with a vertical side of the door frame.

Objects of the present invention having been stated hereinabove, and which are addressed in whole or in part by the present invention, other objects will become evident as the description proceeds when taken in connection with the accompanying drawings as best described hereinbelow.

DETAILED DESCRIPTION OF THE INVENTION

Figure 1A:
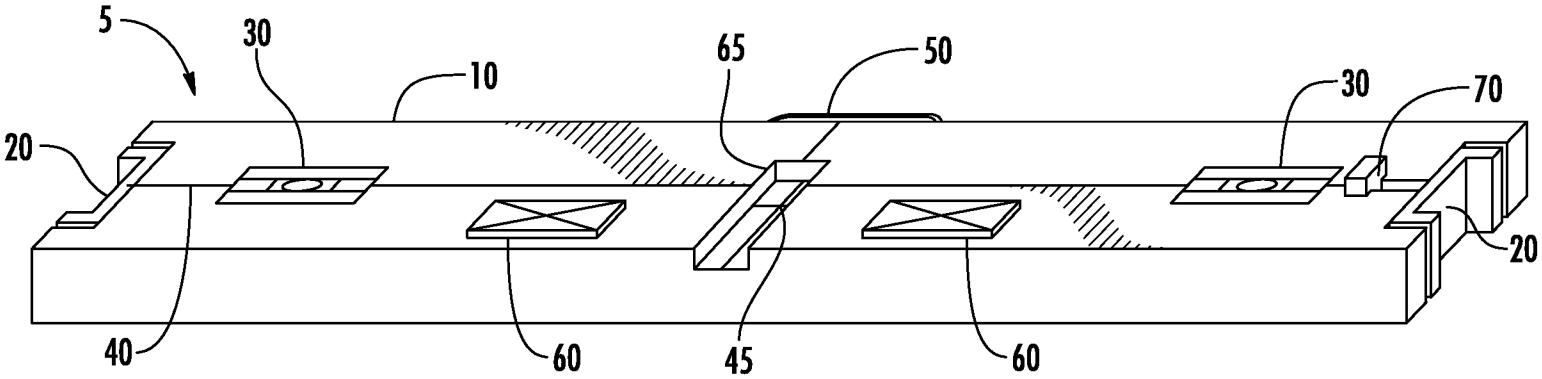
FIG. 1A is a perspective view of a door frame tool of the present invention.
Figure 1B:
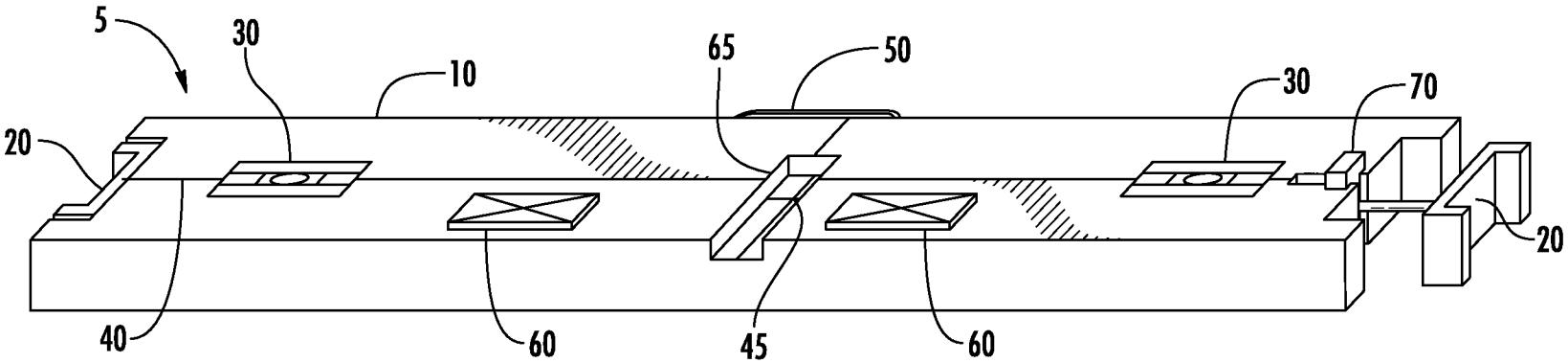
FIG. 1B is another perspective view of the door frame tool of the present invention illustrating the tool in an extended position.
Figure 2:
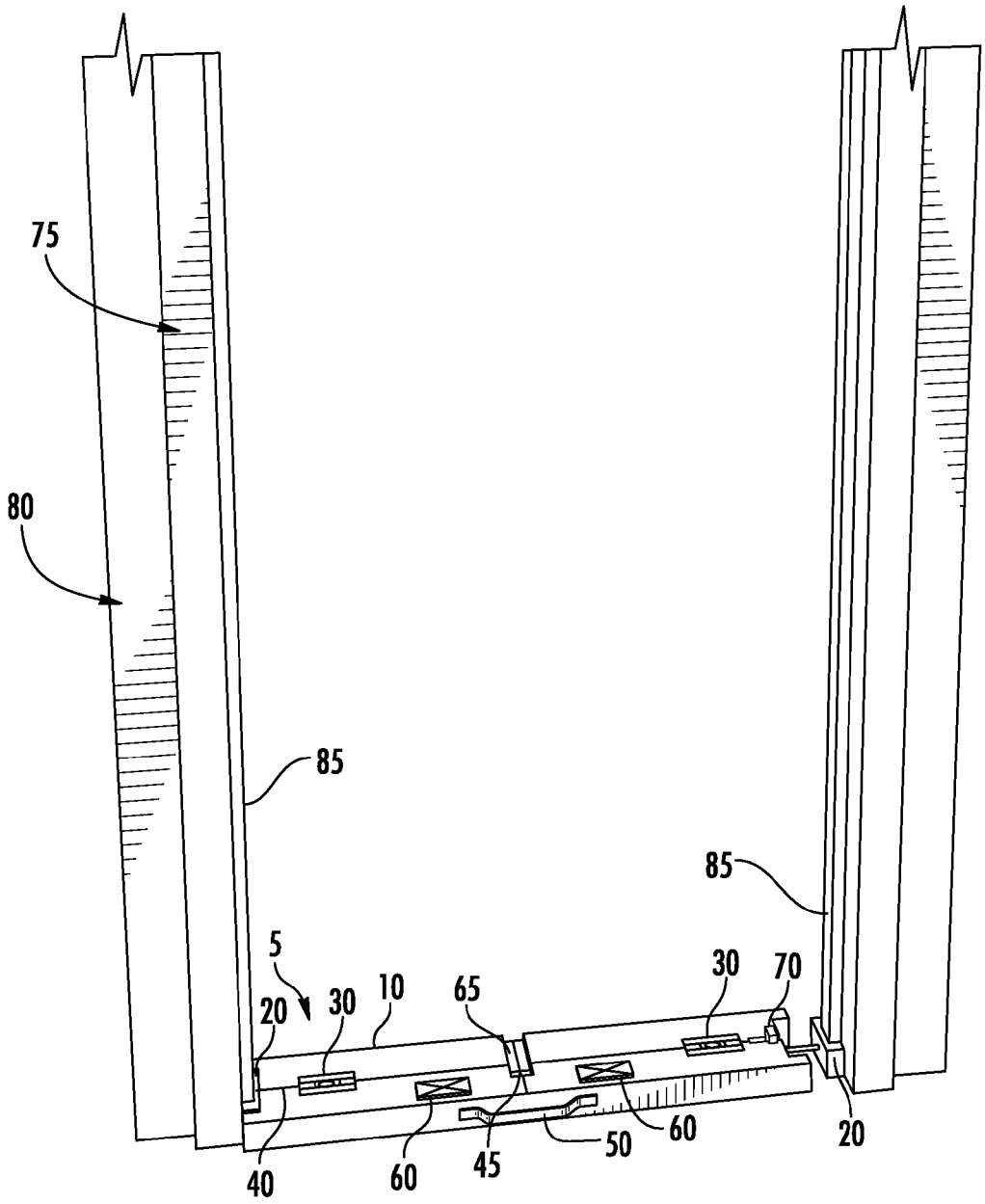
FIG. 2 is a perspective view of a door frame with a door frame tool of the present invention.

Referring now to FIGS. 1A-B and 2, door frame tool 5 of the present invention is shown having a main body member 10, which is preferably in a generally rectangular shape and is made of a sturdy material. Main body member 10 may be made of plastic, metal, such as aluminum or steel, wood, composite or synthetic resin, or any other suitable durable material.

At least one magnet 20 is affixed to each of the shorter sides of main body member 10. As shown in FIG. 1, each magnet 20 is attached to, or integrated with main body member 10 such that the top of magnet 20 is generally on the same plane as the shorter sides of main body member 10. In one embodiment one or more of magnets 20 are extendable from, and retractable into, main body member 10 by, for example, lever 70, or other suitable mechanism capable of extending and retracting one or more of magnets 20 from, and/or into, main body member 10. In one example, one or more of magnets 20 are extended by lever 70, and locked into place to achieve an overall door frame tool 5 length of about 36 inches. In one embodiment the one or more of magnets 20 are extendable to about 2 inches from main body member 10. Having one or more extendable/retractable magnets 20 provides for easier insertion and removal of door frame tool 5, and helps to avoid scratching of a door frame, such as door frame 75, during use. In other embodiments, magnets 20 may protrude out or recede in from the shorter sides of main body member 10. Magnets 20 may have a thin layer of fabric or other coating suitable to prevent magnets 20 from scratching door frame 75. Magnets 20 are preferably of a generally "C" or "U" shape; however, magnets 20 may be of any other suitable shape, such as, rectangular, circular, oval, or square.

Embedded within main body member 10 is at least one leveling device 30, such as a carpenter's level. Leveling device 30 typically includes a one or more sight glasses, which is filled with a liquid and contains an air bubble therein. Leveling devices are well known in the art and will not be described further herein. In a preferred embodiment door frame tool 5 includes two leveling devices 30, for example one disposed toward each end of door frame tool 5, such as shown in FIGS. 1A and B. However, while two leveling devices are disclosed in a preferred embodiment, door frame tool 5 in other embodiments may include more or less than two leveling devices 30. Leveling device 30 shows whether a door frame 75, such as a metal door frame, is level, for example, in relation to the floor. If door frame 75 is not level then door frame 75 may be adjusted to bring it level.

In addition, a center line 40 may be shown on door frame tool 5 to aid in properly installing door frame 75. A center point 45 may be shown in the middle of door frame tool 5 and intersect center line 40 to aid in squaring door frame 75 and to further aid in properly aligning door frame 75 during installation. In an embodiment where one or more of magnets 20 are extendable, center point 45 is located at the middle of door frame tool 5, wherein the middle of door frame tool 5 is based on its extended length. For example, if door frame tool 5, in an extended state, is 36 inches in overall length, then center point 45 would be located 18 inches from an end of extended door frame tool 5. Additionally, a slot 65 may be present at center point 45 to accept, for example, a laser device, such as multidirectional laser device (not shown), which can also be used for aiding in measuring, squaring, and proper alignment of door frame 75 during installation. Slot 65 may further include an adjustable locking mechanism (not shown), such as a mechanical slide, to secure the multidirectional laser device in slot 65. Slot 65 is preferably configured to accommodate most all commercially available multidirectional laser devices. Further, one or more optional spacers 60 may be removably attached to door frame tool 5, and may be used to help space and align door frame 75 in relation to door frame studs 80. In one embodiment one or more spacers 60 may be tethered to door frame tool 5 to prevent misplacing or losing spacers 60. Optionally, door frame tool 5 may further include a carrying handle 50 for ease in transporting the tool.

Door frame tool 5 is preferably of predetermined dimensions related to the standard or custom dimensions of door frame 75. In one particular embodiment, the apparatus is approximately 36 inches (91.4 cm) long in an extended position, so that a doorway of 36 inches in width can be constructed from door frame 75. Door frame tool 5 may be constructed using other dimensions depending on the size of a particular door frame 75.

FIG. 2 illustrates door frame tool 5 of the present invention in conjunction with a door frame 75, such as a metal door frame. Magnets 20 of door frame tool 5 are used to situate door frame 75 to its proper position and spacing and to square door frame 75 top to bottom, meaning that the four corners of door frame 75 are at substantially 90° angles. Door frame studs 80 may be properly placed in relation to door frame 75 using spacers 60. Spacers 60 facilitate proper spacing of door frame studs 80 in relation to door frame 75 during installation, and facilitate proper installation of drywall for example.

The present invention also provides methods for squaring, positioning, and leveling door frame 75, such as a metal door frame. In one particular method of the present invention door frame tool 5 is positioned where a doorway is desired using center line 40, center point 45, and/or optionally a laser device, such as a multidirectional laser device, positioned in slot 65 of door frame tool 5. In the event a multidirectional laser device, or similar tool, is not available, then the method may employ the use of a plumb bob, such as a magnetic plumb. One or more of magnets 20 are extended to extend door frame tool 5 to its desired length, e.g., 36 inches, using lever 70, for example. Door frame 75 is brought to door frame tool 5 such that the bottom vertical portions of door frame 75 are in contact with magnets 20 on each side of door frame tool 5 via interaction with magnets 20. Magnets 20 are preferably brought into contact with the bottom vertical portions of door frame 75 such that the magnets are in contact with either side of door jamb 85, wherein door jamb 85 fits in the C shaped channel of magnets 20. This aids to square door frame 75 top to bottom, thus correctly positioning and spacing door frame 75. Level 30 of door frame tool 5 is used to level door frame 75 in relation to the floor. If needed door frame 75 is adjusted to make it level. In addition, optional spacers 60 may be used to position door frame 75 correctly in relation door frame studs 80, e.g., to correctly space door frame 75 in relation to door frame studs 80, for example to allow for proper placement and installation of drywall, and may further help to ensure that door frame 75 is centered within the opening. Further, the user may employ an optional laser device on door frame tool 5 to aid in squaring of door frame 75. In such an example, the multidirectional laser is inserted into slot 65 and activated. The multidirectional laser aids in determining the center point at the top of door frame 75 by using, for example, center point 45 of door frame tool 5 as a reference and directing a laser to the true center point of the top of door frame 75. This establishes a true vertical line for each vertical leg of door frame 75, and ensures door frame 75 is square top to bottom. If a multidirectional laser is not available, or used, the user may use a plumb bob, such as a magnetic plumb bob, dropped from the top of door frame 75 and uses center point 45 as a reference point to ensure door frame 75 is square top to bottom. Once door frame 75 is squared, properly aligned, leveled, and spaced door frame 75 is secured to door frame studs 80 and the floor. Once door frame 75 is secured and permanently installed door frame tool 5 is removed.

The foregoing detailed description of embodiments refers to the accompanying drawings, which illustrate specific embodiments of the invention. Other embodiments having different structures and operations do not depart from the scope of the present invention. The term "the invention" or the like is used with reference to certain specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. An apparatus for squaring, positioning, and leveling a door frame, the apparatus comprising:

a. a generally rectangular body;

b. at least two magnets, one on each shorter side of the rectangular body, wherein at least one of the at least two magnets is extendable from at least one of the shorter sides of the rectangular body;

c. at least one leveling device attached to the rectangular body;

d. a line parallel to the longer sides of the rectangular body in the center of the rectangular body and extending the length of the rectangular body; and e. a center point at the middle of the apparatus.

2. The apparatus of claim 1 comprising at least two leveling device attached to the rectangular body.

3. The apparatus of claim 1 wherein the door frame comprises a metal door frame.

4. The apparatus of claim 1 wherein the at least two magnets have a C shaped configuration.

5. The apparatus of claim 1 further comprising a slot formed at the center point.

6. The apparatus of claim 5 wherein the slot is configured to accept a laser device.

7. The apparatus of claim 6 wherein the slot comprises an adjustable locking mechanism configured to secure the laser device in the slot.

8. The apparatus of claim 1 further comprising a handle to carry the apparatus.

9. The apparatus of claim 1 further comprising one or more removable spacers.

10. The apparatus of claim 1 wherein the at least one of the at least two magnets is extendable by a mechanical lever.

11. The apparatus of claim 1 further comprising a center point located at the middle of the apparatus wherein the middle of the apparatus is measured based on the apparatus having at least one of the at least two magnets extended.

12. The apparatus of claim 11 further comprising a slot formed at the center point.

13. The apparatus of claim 1 wherein the apparatus in an extended state is approximately 36 inches in length.

14. A method of squaring, positioning, and leveling a door frame, the method comprising:

a. providing an apparatus for positioning and leveling a door frame, the apparatus comprising:

i. a generally rectangular body;

ii. at least two magnets, one on each shorter side of the rectangular body, wherein at least one of the at least two magnets is extendable from at least one of the shorter sides of the rectangular body; and iii. at least one leveling device attached to the rectangular body;

b. placing the apparatus of the invention where a doorway is desired;

c. contacting each vertical side of the door frame to the apparatus such that each magnet of the apparatus is in magnetic contact with a vertical side of the door frame;

d. leveling the door frame in relation to the floor using the at least one leveling device of the apparatus;

e. securing the door frame; and f. removing the apparatus.

15. The method of claim 14 wherein the apparatus further comprises a line parallel to the longer sides of the rectangular body in the center of the rectangular body and extending the length of the rectangular body.

16. The method of claim 15 wherein the apparatus further comprises a center point at the middle of the apparatus.

17. The method of claim of claim 16 wherein the apparatus further comprises a slot formed at the center point.

18. The method of claim 17 wherein the slot is configured to accept a laser device.

19. The method of claim 18 wherein the laser device is used to aid in squaring the door frame.

20. The apparatus of claim 18 wherein the slot comprises an adjustable locking mechanism configured to secure the laser device in the slot.

21. The method of claim 14 further comprising positioning one or more door frame studs correctly relative to the door frame.

22. The method of claim 21 wherein securing the door frame comprises securing the door frame to the one or more door frame studs.

23. The method of claim 14 wherein the door frame comprises a metal door frame.

24. The apparatus of claim 14 wherein the at least two magnets have a C shaped configuration.

25. The method of claim 14 wherein the apparatus comprises at least two leveling device attached to the rectangular body.

26. The method of claim 14 wherein the apparatus further comprises a handle to carry the apparatus.

27. The method of claim 14 wherein the apparatus further comprises one or more removable spacers.

28. The method of claim 27 wherein the spacers are configured in size and shape to assist in positioning the door frame correctly relative to the door frame studs.

29. The method of claim 14 wherein the at least one of the at least two magnets is extendable by a mechanical lever.

30. The method of claim 14 wherein the apparatus further comprises a center point located at the middle of the apparatus wherein the middle of the apparatus is measured based on the apparatus having at least one of the at least two magnets extended.

31. The method of claim 30 further comprising a slot formed at the center point.

32. The method of claim 14 wherein the apparatus in an extended state is approximately 36 inches in length.

* * * * *